US007569777B1

(12) United States Patent
Gillam

(10) Patent No.: US 7,569,777 B1
(45) Date of Patent: Aug. 4, 2009

(54) THERMOSTAT WITH LOCK FOR INHIBITING REMOVAL AND ACCESS

(75) Inventor: Christina M. Gillam, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 12/113,661

(22) Filed: May 1, 2008

(51) Int. Cl.
*H01R 13/502* (2006.01)

(52) U.S. Cl. ..... 174/562; 174/50; 174/561; 220/210; 220/242

(58) Field of Classification Search ..... 174/562, 174/561, 50; 220/210, 242
See application file for complete search history.

(56) References Cited

U.S. PATENT DOCUMENTS 3,752,900 A * 8/1973 Harrison et al. ..... 174/562
4,588,851 A * 5/1986 Turner ..... 174/5 R
4,840,584 A * 6/1989 Cox ..... 439/538
6,024,236 A * 2/2000 Jannot et al. ..... 220/4.02
6,028,268 A * 2/2000 Stark et al. ..... 174/67
7,227,083 B2 * 6/2007 Ciemny et al. ..... 174/66
2003/0127458 A1 7/2003 Dushane et al.
2007/0144779 A1 * 6/2007 Vicente et al. ..... 174/520
2008/0257601 A1 * 10/2008 Fabrizi et al. ..... 174/545

* cited by examiner

*Primary Examiner*—Hung V Ngo
(74) *Attorney, Agent, or Firm*—Harness, Dickey & Pierce, P.L.C.

(57) ABSTRACT

A thermostat is provided that includes a lock disposed in a sub-base, which includes a cam coupled to the lock to permit rotation of the cam between an unlocked and a locked position. The cam includes an offset portion that is configured to rotate over a vertical retaining portion of the thermostat housing, to retain the thermostat housing to the sub-base. The cam further includes an outwardly extending portion, wherein the outwardly extending portion is configured to rotate adjacent to a door that is pivotally coupled to the thermostat housing. When the cam is in the locking position, pivoting of the door is impeded by the outwardly extending portion of the cam, to resist pivotal movement of the door and thereby inhibit access to one or more input means or controls of the thermostat.

20 Claims, 7 Drawing Sheets

THERMOSTAT WITH LOCK FOR INHIBITING REMOVAL AND ACCESS

FIELD

The present disclosure relates to thermostats, and more specifically to thermostats that include locking features for preventing access to the thermostat controls.

BACKGROUND

The statements in this section merely provide background information related to the present disclosure and may not constitute prior art.

Various locking covers for thermostats have been attempted that enclose substantially the entire thermostat, and thus have to deal with the problem of inadequate flow of air into and out of the cover for sensing temperature. The barrier to air flow necessarily makes the thermostat less responsive to actual temperature changes in the room. The present construction of thermostat cases, especially for digital and programmable thermostats, typically is wall-mounted, and includes a sub-base on which the thermostat is removably connected. Such sub-base mounting systems permit the thermostat to be removed by persons who may attempt to change the thermostat's settings.

SUMMARY

The present application discloses various embodiments of a wall-mounted thermostat that includes a sub-base, a pivotal door, and a locking component. In one embodiment, a thermostat is provided that includes a lock disposed in a sub-base, which includes a cam coupled to the lock to permit rotation of the cam between an unlocked and a locked position. The cam includes an offset portion that is configured to rotate over a vertical retaining portion of the thermostat housing, to retain the thermostat housing to the sub-base. The cam further includes an outwardly extending portion, wherein the outwardly extending portion is configured to rotate adjacent to a door that is pivotally coupled to the thermostat housing. When the cam is in the locking position, pivoting of the door is impeded by the outwardly extending portion of the cam, to resist pivotal movement of the door and thereby inhibit access to one or more input means or controls of the thermostat.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
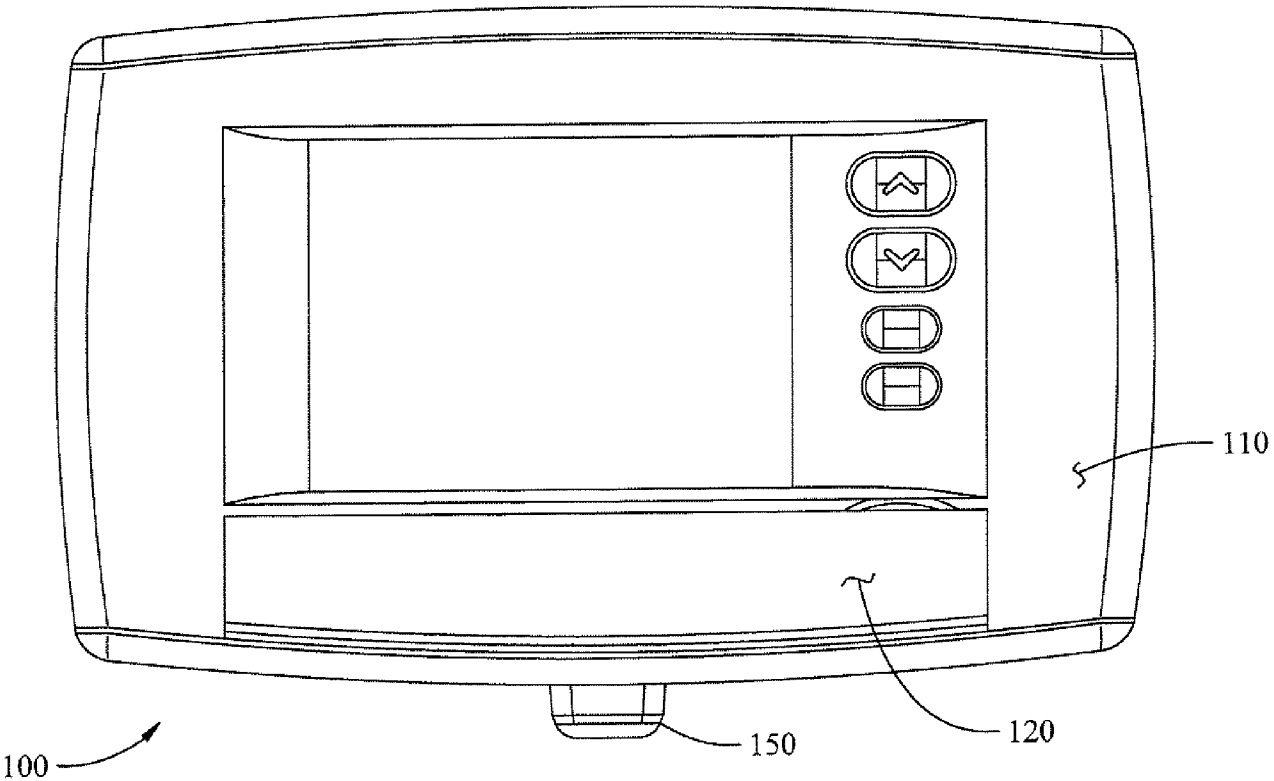
FIG. 1 is a front plane view of one embodiment of a thermostat and sub-base according to the principles of the present application.

The following description is merely exemplary in nature and is not intended to limit the present disclosure, application, or uses. It should be understood that throughout the drawings, corresponding reference numerals indicate like or corresponding parts and features.

There is provided, in accordance with one aspect of the present application, a locking feature for inhibiting access to controls for a thermostat of the type having an access door. There are numerous thermostats for controlling a heating or cooling system to maintain a desired temperature, some of which may include a door that pivots to permit access to one or more controls of the thermostat. Typical thermostats are also mounted to a wall by connection to a sub-base that is secured to the wall. The present application discloses a new locking feature for a thermostat including a door and a sub-base, which when locked, inhibits removal of the thermostat from the sub-base, and also inhibits opening of the door to thereby restrict access. One embodiment of such a wall mounted thermostat assembly is shown generally at 100 in FIG. 1. The thermostat includes a thermostat housing 110, a pivotal door 120 and a lock 150 disposed near the bottom of the thermostat.

Figure 2:
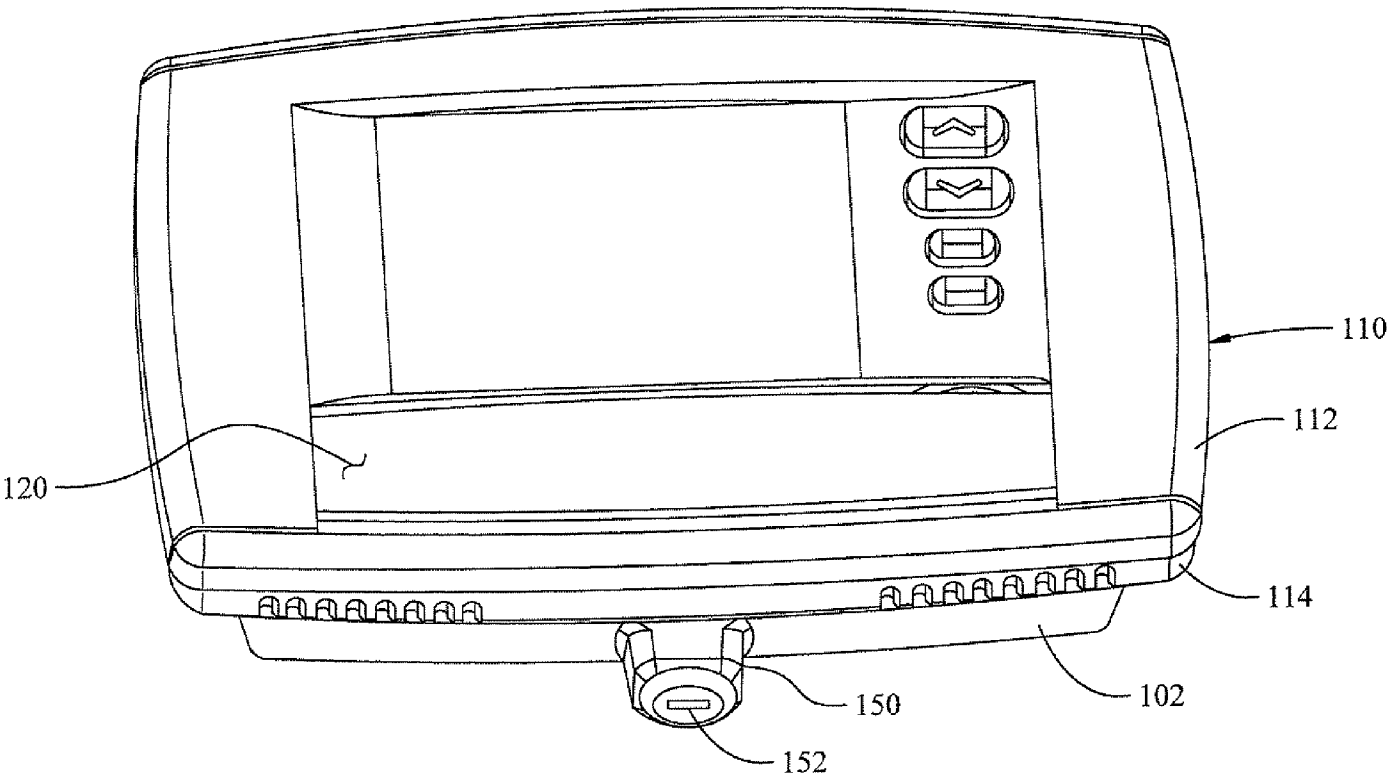
FIG. 2 is a front perspective view of the thermostat and sub-base of FIG. 1.

Referring to FIG. 2, the wall mounted thermostat assembly includes a sub-base 102 adapted to be mounted against a wall, and a thermostat housing 110 having a front portion 112 and a back portion 114, and a door 120. The thermostat further includes a lock 150 with a key slot 152, where the lock 150 is disposed on the sub-base 102 of the thermostat 100. It should be noted that while the lock 150 is shown on the bottom of the sub-base, the lock could alternatively be mounted on the side or top of the thermostat.

Figure 3:
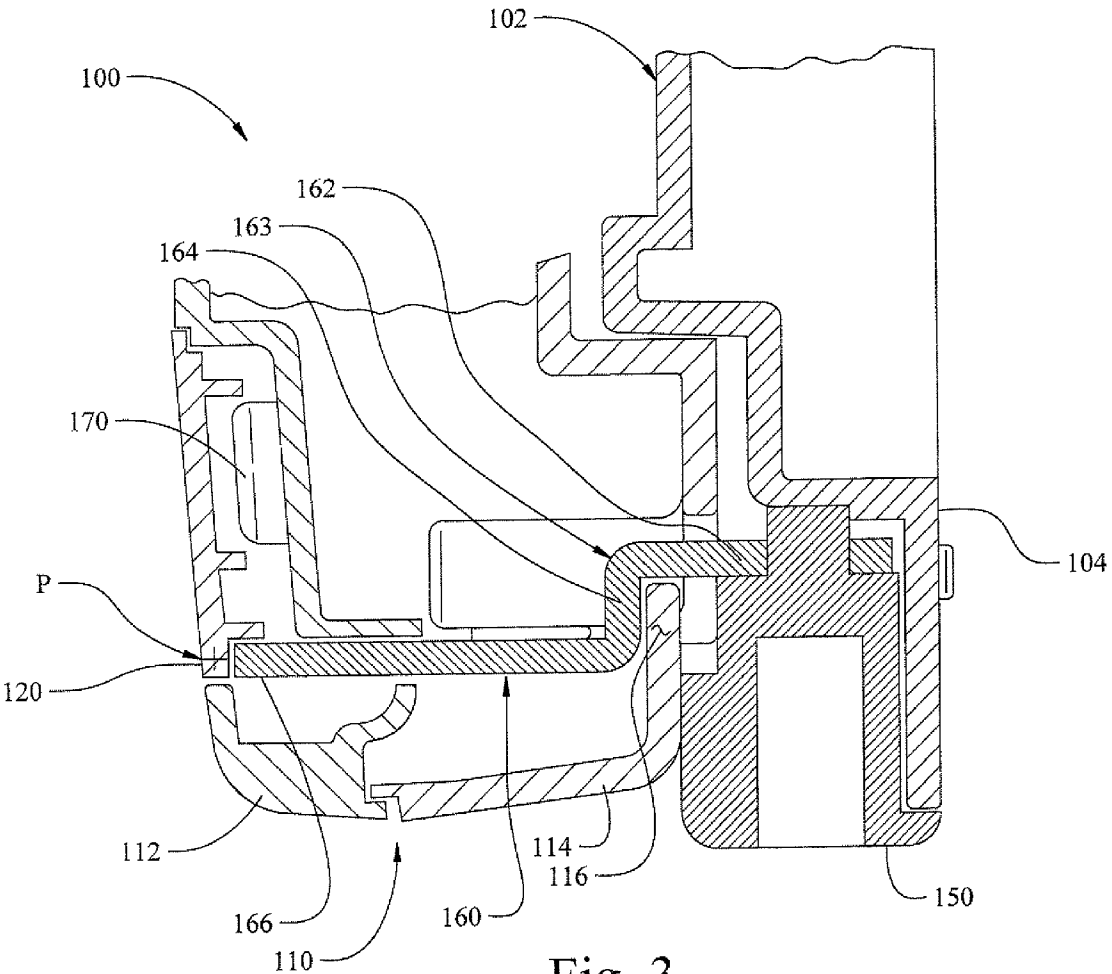
FIG. 3 is a cross-sectional view of a portion of the thermostat and sub-base of FIG. 1.

Referring to FIG. 3, the thermostat 100 and locking feature are shown in more detail. As shown, the thermostat 100 comprises a sub-base having a mounting surface 104 adapted to be mounted against a wall 102, on which the thermostat or thermostat housing 110 is connected to. The thermostat housing 110 includes a front portion 112, a back portion 114, and a vertical retaining wall 116, which is positioned in the housing portion so as to align relative to the lock 150.

The thermostat 100 further includes a door 120 pivotally coupled to the front portion 112 of the thermostat housing 110. The door 120 is configured to pivot about a hinge point "P". The door 120 preferably pivots between a closed position, as shown in FIG. 3, in which the door is substantially flush with the front of the thermostat, and an open position (not shown). When the door is pivoted to an open position, one or more input means for the thermostat, such as button 170, may be accessed by a user of the thermostat.

The thermostat 100 further includes a rotating lock 150 disposed in the sub-base, which includes a cam 160 that is coupled at its pivotal end 162 to the lock 150. The pivotal coupling of the cam permits rotation of the cam 160 between an unlocked position (not shown) and a locked position as shown in FIG. 3. The cam 150 includes a bend 163 therein orthogonal to the pivotal end, for forming an offset portion 164 that is configured to rotate over a portion of the vertical retaining wall 116. The offset portion 164 thereby retains the vertical wall 116 of the thermostat housing, relative to the sub-base, when the cam 160 is rotated to the locked position. The cam 160 further includes an outwardly extending portion 166 depending from the offset portion 164. The outwardly extending portion 166 is configured to rotate adjacent to a back surface of the door 120 when the cam 160 and/or lock are rotated to the locking position, as shown in FIG. 3. The outwardly extending portion 166 rotates to a position adjacent the door 120, such that pivoting movement of the door 120 is impeded by the outwardly extending portion 166 of the cam, to thereby resist opening of the door 120 to inhibit access to the one or more input means 170.

Figure 4:
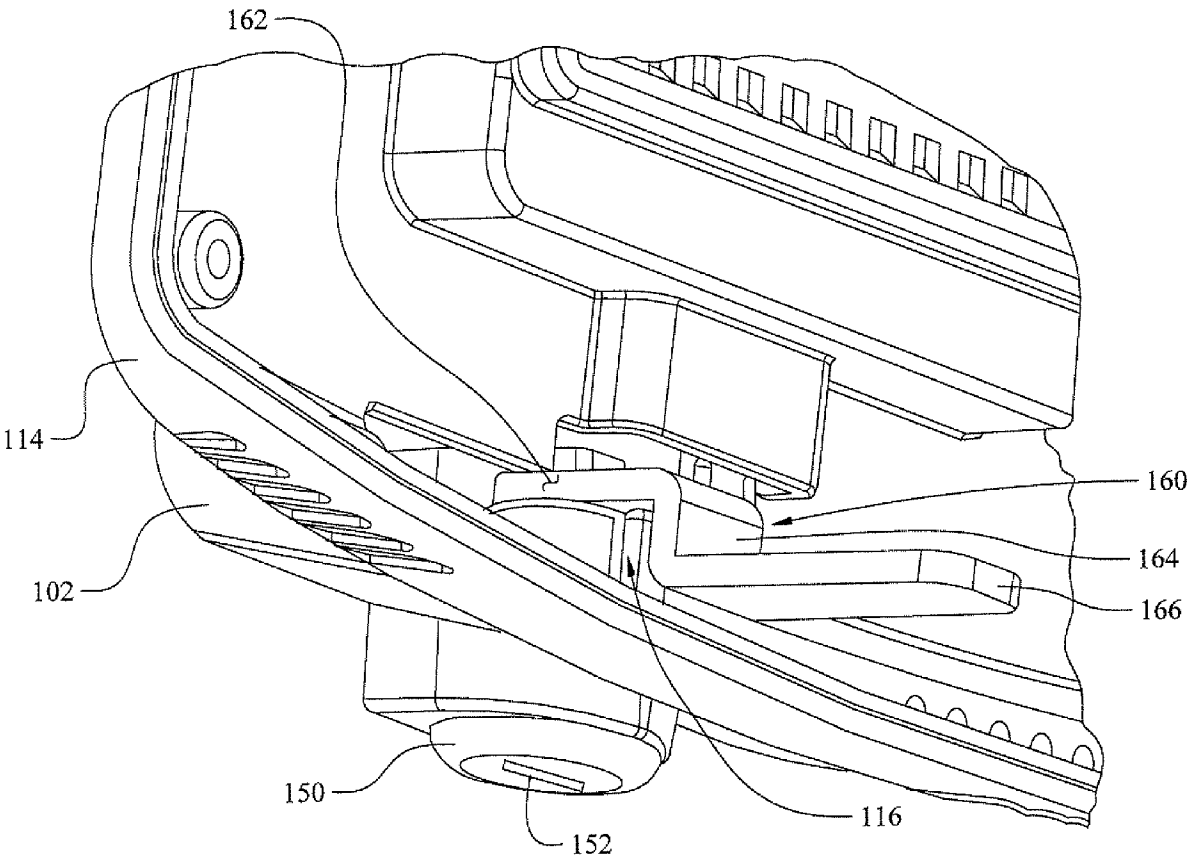
FIG. 4 is a cut-away view of the locking feature of the thermostat of FIG. 1.

When the lock 150 and/or cam 160 are rotated to an unlocked position, the cam 160 is substantially parallel with and disposed within a portion of the sub-base 102, behind the thermostat housing. In this position, the thermostat housing 110 may be removed from the sub-base 102. In the unlocked position, the door 120 may also be opened to access one or more input means, such as a programming button 170. When the lock 150 and/or cam 160 to a locked position as shown in FIG. 4, cam 160 is substantially perpendicular to the sub-base 102, or the plane of the mounting surface 104.

Figure 5:
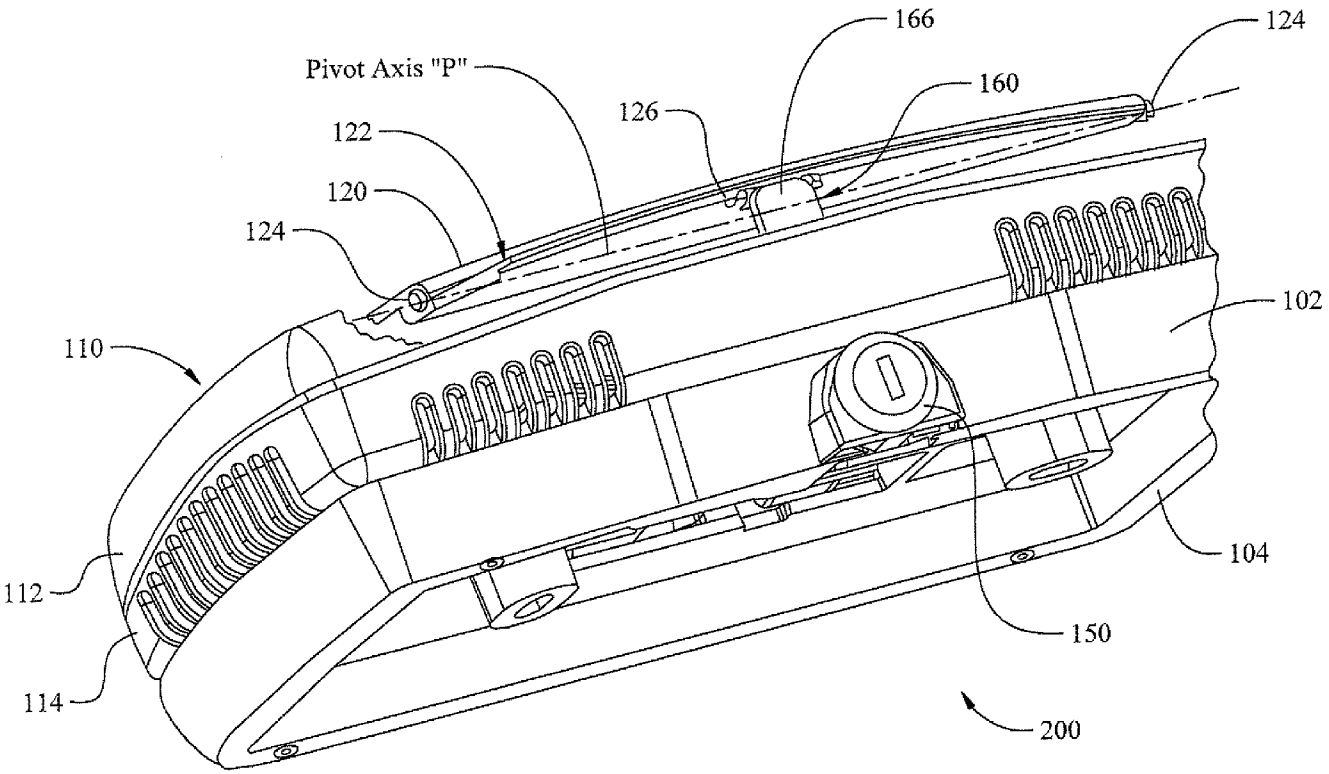
FIG. 5 is a perspective view of a second embodiment of a thermostat, with a portion cut-away to reveal the locking cam and door.

Referring to FIG. 5, a second embodiment of a wall mounted thermostat 200 is shown. The thermostat 200 is similar to the first embodiment, and corresponding reference numerals indicate like or corresponding parts and features. The thermostat 200 includes a sub-base 102 having a mounting surface 104 adapted to be mounted against a wall, and a thermostat housing 110 having a front portion 112, a back portion 114, and a vertical retaining wall (not shown). The thermostat further includes a door 120 pivotally coupled to the thermostat housing portion 112. The door 120 is configured to pivot about a hinge point or axis "P", between a closed position in which the door is substantially flush with the front portion 112 of the thermostat, and an open position in which one or more input means for the thermostat are accessible.

In the second embodiment of a thermostat shown in FIG. 5, the door 120 further includes a lip 122 extending below or beyond the hinge point "P" about which the door 120 pivots. The thermostat 200 includes a lock 150 disposed in the sub-base 102. The lock 150 includes a cam 160 that is coupled at its pivotal end to the lock 150, to permit rotation of the cam 160 between an unlocked position (not shown) and a locked position, as shown in FIG. 5. The cam includes a bend therein orthogonal to the pivotal end, which bend forms an offset portion that is configured to rotate over a portion of the vertical retaining wall, as described in the first embodiment and shown in FIG. 3. In the locked position, the offset of the cam retains the thermostat housing to the sub-base. The cam 160 further includes an outwardly extending portion 166, wherein the outwardly extending portion 166 is configured to rotate adjacent to the lip 122 of the door 120 when the cam 160 is in the locking position. The position of the outwardly extending portion 166 relative to the lip 122 of the door 120 is such that pivoting of the door 120 is impeded by the lip 122, which engages the outwardly extending portion 166 of the cam. Accordingly, the lip 122 extending below the hinge or pivot axis "P" resists movement of the door, to thereby inhibit access to the one or more input means.

Figure 6:
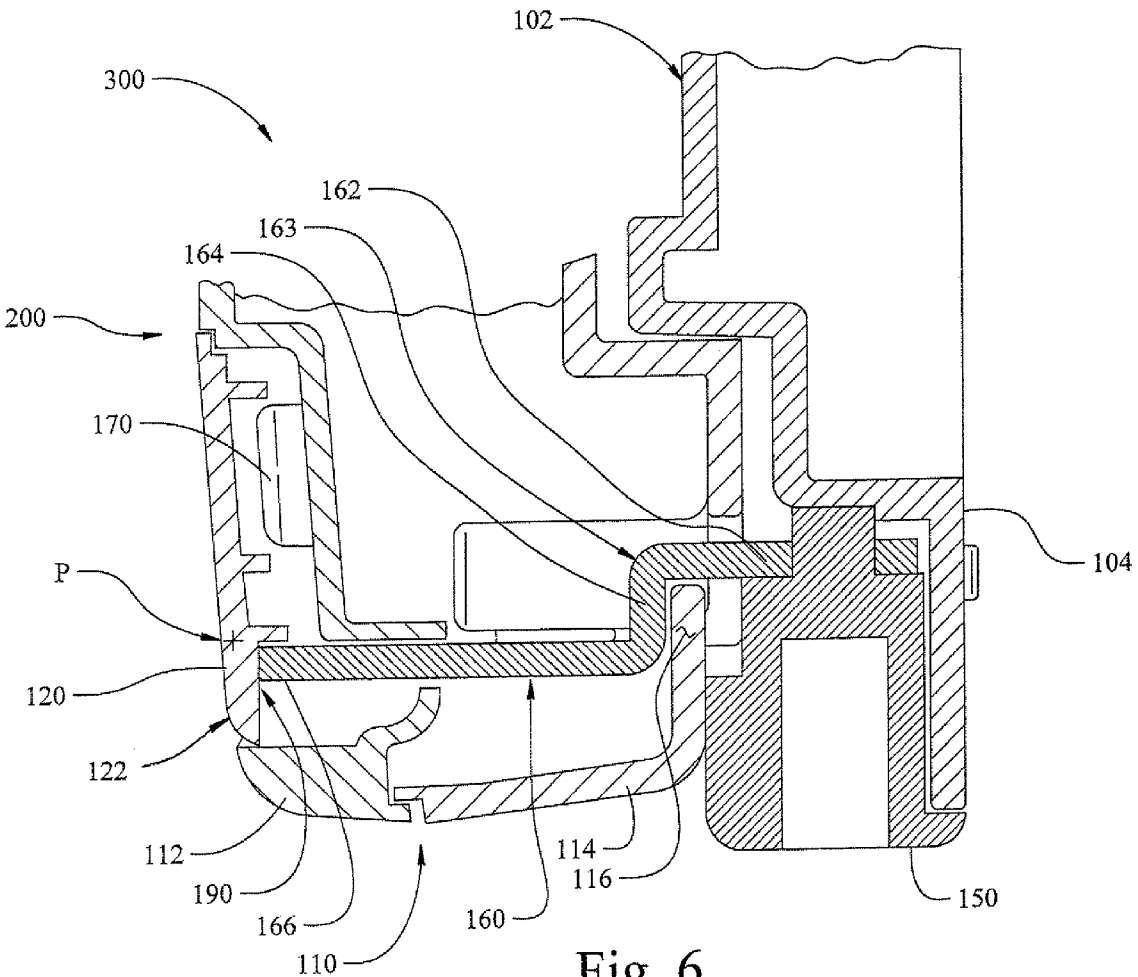
FIG. 6 is a cross-sectional view of a third embodiment of a thermostat and sub-base according to the principles of the present application.

Referring to FIG. 6, an alternate third embodiment of a wall mounted thermostat 300 is shown. The thermostat 300 is similar to the first embodiment, and corresponding reference numerals indicate like or corresponding parts and features. The thermostat 300 includes a sub-base 102 having a mounting surface 104 adapted to be mounted against a wall, and a thermostat housing 110 having a front portion 112, a back portion 114, and a vertical retaining wall (not shown). The thermostat 300 further includes a door 120 pivotally coupled to the thermostat housing portion 112. The door 120 is configured to pivot about a hinge point or axis "P", between a closed position in which the door is substantially flush with the front portion 112 of the thermostat, and an open position in which one or more input means for the thermostat are accessible.

In the third embodiment of a thermostat 300 shown in FIG. 6, the door 120 further includes a lip 122 extending below or beyond the hinge point "P" about which the door 120 pivots. The thermostat 200 includes a lock 150 disposed in the sub-base 102. The lock 150 includes a cam 160 that is coupled at its pivotal end to the lock 150, to permit rotation of the cam 160 between an unlocked position (not shown) and a locked position, as shown in FIG. 5. The cam 160 includes a bend 163 therein orthogonal to the pivotal end 162, which bend forms an offset portion 164 that is configured to rotate over a portion of the vertical retaining wall 116, as shown in FIG. 6. In the locked position, the offset 164 of the cam retains the thermostat housing to the sub-base. The cam 160 further includes an outwardly extending portion 166, wherein the outwardly extending portion 166 is configured to rotate adjacent to the lip 122 of the door 120, as shown in FIG. 6. When the cam 160 is in the locking position, pivoting of the door 120 is impeded by the pressure of the outwardly extending portion 166 of the cam against the lip 122 of the door 120. The lip 122 of the door engages the outwardly extending portion 166 of the cam 160, such that the pressure of the outwardly extending portion 166 against lip 122 (at point 190) resists pivotal movement of the door 120 to maintain the position of the door flush with the front of the thermostat portion 112. Accordingly, the lip 122 extending below the hinge or pivot axis "P", and the pressure of the outwardly extending portion 166 against lip 122, resists movement of the door 120 to thereby inhibit access to the one or more input means.

Figure 7:
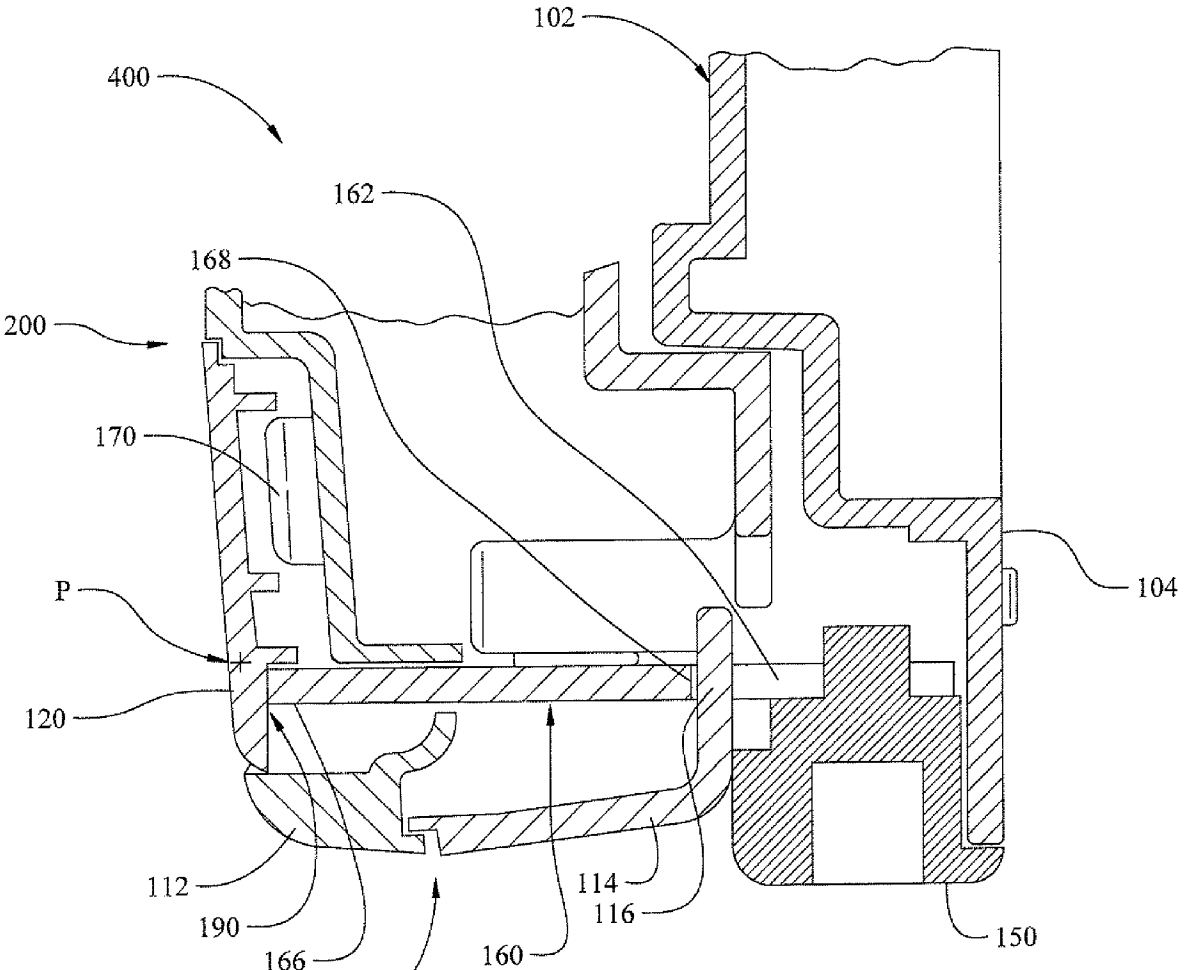
FIG. 7 is a cross-sectional view of a fourth embodiment of a thermostat and sub-base according to the principles of the present application.

Referring to FIG. 7, a fourth embodiment of a wall mounted thermostat 400 is shown. The thermostat 400 is similar to the first embodiment, and corresponding reference numerals indicate like or corresponding parts and features. The thermostat 400 includes a sub-base 102 having a mounting surface 104 adapted to be mounted against a wall, and a thermostat housing 110 having a front portion 112, a back portion 114, and a vertical retaining wall (not shown). The thermostat 300 further includes a door 120 pivotally coupled to the thermostat housing portion 112. The door 120 is configured to pivot about a hinge point or axis "P", between a closed position in which the door is substantially flush with the front portion 112 of the thermostat, and an open position in which one or more input means for the thermostat are accessible.

In the fourth embodiment of a thermostat 400 shown in FIG. 7, the door 120 further includes a lip 122 extending below or beyond the hinge point "P" about which the door 120 pivots. The thermostat 400 includes a lock 150 disposed in the sub-base 102. The lock 150 includes a cam 160 that is coupled at its pivotal end 162 to the lock 150, to permit rotation of the cam 160 between an unlocked position (not shown) and a locked position, as shown in FIG. 7. The cam includes a notch 168, which forms a retaining portion that is configured to rotate over or against a portion of the vertical retaining wall 116, as described in the first embodiment and shown in FIG. 7. In the locked position, the notch or retaining portion 168 retains the thermostat housing to the sub-base. The cam 160 further includes an outwardly extending portion 166, wherein the outwardly extending portion 166 is configured to rotate adjacent to the lip 122 of the door 120 when the cam 160 is in the locking position. The position of the outwardly extending portion 166 relative to the lip 122 of the door 120 is such that pivoting of the door 120 is impeded by the lip 122, which engages the outwardly extending portion 166 of the cam. Accordingly, the lip 122 extending below the hinge or pivot axis "P" resists movement of the door, to thereby inhibit access to the one or more input means.

It should be noted that the outwardly extending portion 166 in the above embodiment may alternatively include a second notch (not shown) at the end of the cam 160. The second notch in this alternate embodiment is configured to engage a feature or slot on the door 120, to thereby resist opening of the door. In this alternate embodiment, the cam end 166 would resist opening of the door 120 because the second notch would "latch" onto the feature of the door, and prevent the door from pivoting open. It should be noted that the cam 160 and second notch may be configured to engage the door 120 above the pivot point "P".

In addition to the above embodiments, other alternate embodiments of a thermostat with a locking feature according to the principles of the present invention may include additional locking features. For example, the thermostat embodiments may further include a switch (not shown) disposed within the thermostat housing that, when depressed, is configured to lock-out one or more input means to the thermostat. The switch is preferably positioned relative to the lock and cam such that the outwardly extending portion of the cam is configured to engage the switch when the cam is rotated to a locking position, to thereby prohibit the use of one or more input means. The thermostat embodiments may further include a display device 180, as shown in FIG. 1. The thermostat display 180 is preferably configured to display indicia indicating that the thermostat door is locked when the cam depresses the switch that prohibits the use of one or more input means.

It will be understood by those skilled in the art that the above thermostat locking feature may be employed in various types of thermostats with any combination of the above disclosed features, without implementing the others. It will be understood that the thermostat and locking feature described above may be utilized in other forms of heating and cooling equipment, including remote temperature sensors. Accordingly, it should be understood that the disclosed embodiments, and variations thereof, may be employed in any type of thermostat or heating and cooling component.

What is claimed is:

1. A wall mounted thermostat assembly comprising:

a sub-base having a mounting surface adapted to be mounted against a wall;

a thermostat housing having a front portion, a back portion, and a vertical retaining wall on the back portion of the thermostat housing;

a door pivotally coupled to the thermostat housing, the door being configured to pivot about a hinge point between a closed position in which the door is substantially flush with the front of the thermostat, and an open position in which one or more input means for the thermostat are accessible;

a lock disposed in the sub-base, including a cam that is coupled at its pivotal end to the lock, to permit rotation of the cam between an unlocked position and a locked position, said cam including a bend therein orthogonal to the pivotal end for forming an offset portion that is configured to rotate over a portion of the vertical retaining wall to thereby retain the thermostat housing to the sub-base when the cam is rotated to the locked position, said cam further including an outwardly extending portion depending from the offset portion, wherein the outwardly extending portion is configured to rotate adjacent to a back surface of the door when said cam is in the locking position, such that pivoting movement of the door is impeded by the outwardly extending portion of said cam, to thereby inhibit access to the one or more input means.

2. The thermostat of claim 1 wherein when said cam is rotated to the unlocked position, said cam is substantially parallel with and disposed within a portion of the sub-base.

3. The thermostat of claim 1 wherein when said cam is rotated to the locked position the cam is substantially perpendicular to the sub-base mounting surface.

4. The thermostat of claim 1 wherein said cam is configured to rotate about 90 degrees from the unlocked position to the locked position.

5. The thermostat of claim 1 wherein the door includes a lip extending below said hinge point about which the door pivots.

6. The thermostat of claim 1 wherein the outwardly extending portion is configured to rotate adjacent to the lip of the door when said cam is in the locking position, such that pivoting of the door is impeded by the lip engaging the outwardly extending portion of said cam, to thereby inhibit access to the one or more input means.

7. The thermostat of claim 1, further comprising a switch disposed within the thermostat housing that when depressed is configured to lock-out one or more input means to the thermostat, wherein the outwardly extending portion depending from the offset portion of said cam is configured to engage said switch when said cam is rotated to a locking position, to thereby prohibit the use of one or more input means.

8. The thermostat of claim 1, further comprising a display device, wherein the thermostat display is configured to display indicia indicating that the thermostat door is locked when said cam depresses the switch.

9. The thermostat of claim 1 further comprising a display device, wherein the thermostat display is configured to display indicia indicating that the thermostat door is locked when the outwardly extending portion depending from the offset portion of said cam is rotated to said locking position.

10. The thermostat of claim 1 further comprising a switch disposed within the thermostat housing that when depressed is configured to lock-out one or more input means to the thermostat, wherein the outwardly extending portion depending from the offset portion of said cam is configured to engage said switch when said cam is rotated to a locking position, to thereby prohibit the use of one or more input means.

11. A wall mounted thermostat assembly comprising:

a sub-base having a mounting surface adapted to be mounted against a wall;

a thermostat housing having a front portion, a back portion, and a vertical retaining wall on the back portion of the thermostat housing;

a door pivotally coupled to the thermostat housing, the door being configured to pivot about a hinge point between a closed position in which the door is substantially flush with the front of the thermostat, and an open position in which one or more input means for the thermostat are accessible, wherein the door includes a lip extending below said hinge point about which the door pivots; and a lock disposed in the sub-base, including a cam that is coupled at its pivotal end to the lock, to permit rotation of the cam between an unlocked position and a locked position, said cam including a bend therein orthogonal to the pivotal end, which bend forms an offset portion that is configured to rotate over a portion of the vertical retaining wall to thereby retain the thermostat housing to the sub-base when the cam is rotated to the locked position, said cam further including an outwardly extending portion depending from the offset portion, wherein the outwardly extending portion is configured to rotate adjacent to the lip of the door when said cam is in the locking position, such that pivoting of the door is impeded by the lip engaging the outwardly extending portion of said cam, to thereby inhibit access to the one or more input means.

12. The thermostat of claim 11 wherein the outwardly extending portion depending from the offset portion of said cam is configured to apply pressure to the lip of the door to inhibit the door from being opened.

13. The thermostat of claim 11 wherein when said cam is rotated to the unlocked position, said cam is substantially parallel with and disposed within a portion of the sub-base.

14. The thermostat of claim 13 wherein when said cam is rotated to the locked position, said cam is substantially perpendicular to the mounting surface of the sub-base.

15. The thermostat of claim 14 wherein said cam is configured to rotate about 90 degrees from the unlocked position to the locked position.

16. The thermostat of claim 11, further comprising a switch disposed within the thermostat housing that when depressed is configured to lock-out one or more input means to the thermostat, wherein the outwardly extending portion depending from the offset portion of said cam is configured to engage said switch when said cam is rotated to a locking position, to thereby prohibit the use of one or more input means.

17. The thermostat of claim 16, further comprising a display device, wherein the thermostat display is configured to display indicia indicating that the thermostat door is locked when said cam depresses the switch.

18. A wall mounted thermostat assembly comprising:

a sub-base having a mounting surface adapted to be mounted against a wall;

a thermostat housing having a front portion, a back portion, and a vertical retaining wall on the back portion of the thermostat housing;

a door pivotally coupled to the thermostat housing, the door being configured to pivot about a hinge point between a closed position in which the door is substantially flush with the front of the thermostat, and an open position in which one or more input means for the thermostat are accessible, wherein the door includes a lip extending below said hinge point about which the door pivots; and a lock disposed in the sub-base, including a cam that is coupled at its pivotal end to the lock, to permit rotation of the cam between an unlocked position and a locked position, said cam including a bend therein orthogonal to the pivotal end, which bend forms an offset portion that is configured to rotate over a portion of the vertical retaining wall to thereby retain the thermostat housing to the sub-base when the cam is rotated to the locked position, said cam further including an outwardly extending portion depending from the offset portion, wherein the outwardly extending portion is configured to apply pressure to the lip of the door to inhibit the door from being opened when said cam is rotated to the locking position, such that pivoting movement of the door is impeded by the pressure of the outwardly extending portion of said cam against the lip of the door, to thereby inhibit access to the one or more input means.

19. The thermostat of claim 18 wherein the outwardly extending portion depending from the offset portion of said cam is configured to apply pressure to the lip of the door to inhibit the door from being opened.

20. The thermostat of claim 17 wherein when said cam is rotated to the unlocked position, said cam is substantially parallel with and disposed within a portion of the sub-base.

* * * * *